United States Patent [19]

Glaha et al.

[11] 4,384,380

[45] May 24, 1983

[54] BEDSHEET CONSTRUCTION

[76] Inventors: Kerry L. Glaha, 1860 Ala Moana, #603; Dolores V. Drum, 400 Hobron Ln., #3112, both of Honolulu, Hi. 96815

[21] Appl. No.: 173,449

[22] Filed: Jul. 30, 1980

[51] Int. Cl.[3] ..... A47G 9/00

[52] U.S. Cl. ..... 5/485; 5/486; 5/496; 5/497; 5/502

[58] Field of Search ..... 5/486, 496, 497, 500, 5/502, 485

[56] References Cited

U.S. PATENT DOCUMENTS

| | | | |
|---|---|---|---|
| 2,191,956 | 2/1940 | Coldren | 5/497 |
| 3,467,974 | 8/1969 | Deutsch | 5/496 X |
| 3,681,795 | 8/1972 | Palenske et al. | 5/497 |
| 3,789,441 | 2/1974 | Weiss | 5/497 |
| 4,035,854 | 7/1977 | Pardee | 5/497 |
| 4,145,778 | 3/1979 | Ferrante et al. | 5/496 |

*Primary Examiner*—Francis K. Zugel
*Assistant Examiner*—Michael F. Trettel
*Attorney, Agent, or Firm*—Schapp and Hatch

[57] ABSTRACT

A fitted double sheet for beds having upper and lower sheets notched and sewn together at their foot ends to provide doubled box corners cooperating with single box corners at the head end of the lower sheet to keep the unit in place on the bed. The side portions of the upper sheet are sewn only part way into the doubled box corners so that the side portions can hang free and not impose restrictions on the feet of the user. Elastic strips are provided for keeping the bottom sheet snug on the mattress and such strips are enclosed in fabric pockets running along the joinder between the foot ends of the upper and lower sheets.

2 Claims, 6 Drawing Figures

BEDSHEET CONSTRUCTION

BACKGROUND OF THE INVENTION

1. Field of the Invention

The present invention relates to double sheets for beds, and more particularly to upper and lower sheets which are joined together.

2. Description of the Prior Art

It has previously been known to join upper and lower sheets together along their respective bottom ends for the purpose of facilitating bed making. It has also been known to make box corners in the bottom sheet which fit around the corners of the mattress and retain the bottom sheet in place. Typical prior constructions are set forth in the following United States patents.

| U.S. Pat. No. | Inventor |
|---|---|
| 2,662,234 | B. Citron |
| 3,962,739 | Crockett |
| 4,045,831 | Clark |
| 4,145,778 | Ferrante et al. |
| 4,161,044 | Bogle |

SUMMARY OF THE INVENTION

The novel construction of the present invention provides several advantages over the prior fitted double sheet constructions. The prior constructions are characterized by forming separate pocket corners in both the top and bottom sheets, and by connecting the top and bottom sheets not only along the foot end, but also at least part way along the sides. Because of the fitted nature of the sheets, this keeps both the bottom and top sheets taut at all times, thus providing no accomodation for the feet of the sleeper under the foot end of the top sheet. The construction of the present invention allows the entire side edge of the top sheet to hang free, thus providing unrestricted freedom of movement and lack of pressure on the feet of the person using the bed.

The construction of the present invention also secures the foot ends of the top and bottom sheets together much more securely than the prior devices in a manner also tending to keep the top and bottom sheets aligned as during washing and drying, thus preventing tangling. Further advantages of the construction of the present invention are found in the manner in which the elastic strip used to keep the bottom sheet snugly in place is contained within an elongated envelope formed from the sheet material, thus protecting the elastic strip and providing a more finished appearance. The present construction also makes it possible to manufacture both the bottom and top sheets from rectangular blanks of material, and even from a single blank, thus more efficiently utilizing material as it comes from the looms.

Basically, the described advantages of the present invention are accomplished by forming and sewing the box corners in both the top and bottom sheets so as to make "doubled" box corners, that is, box corners which are two layers in thickness with the two layers being provided by the top sheet and the bottom sheet. The side portions of the top sheet are sewn to the rear portion of the top sheet and to the side and rear portions of the bottom sheet only part way down so that the side portions of the top sheet can hang free and not impose pressure on the feet of the user. When it is desired to make both the top sheet and bottom sheet from a single piece of fabric, the joinder along the bottom edge is accomplished automatically, and the elongated envelope for the elastic strip can be provided simply by taking a tuck in the material along the joinder area.

It is therefore an object of the present invention to provide a fitted double sheet for beds in which the top sheet is not constrained so as to impose pressure on the feet of the user.

Another object of the present invention is to provide a fitted double sheet construction of the character described in which the top and bottom sheets are joined in such manner as to provide additional strength and resistance to misalignment of the top sheet with the bottom sheet.

A further object of the present invention is to provide a fitted double sheet construction of the character set forth in which both the bottom and top sheets may be made from rectangular blanks, thus more efficiently utilizing the fabric.

Yet another object of the present invention is to provide a fitted double sheet of the character described which can be manufactured from a single piece of fabric.

For a fuller understanding of the nature and further objects and features of advantage of the present invention, reference should be had to the following detailed description, taken in connection with the accompanying drawings and the appended claims.

Figure 1:
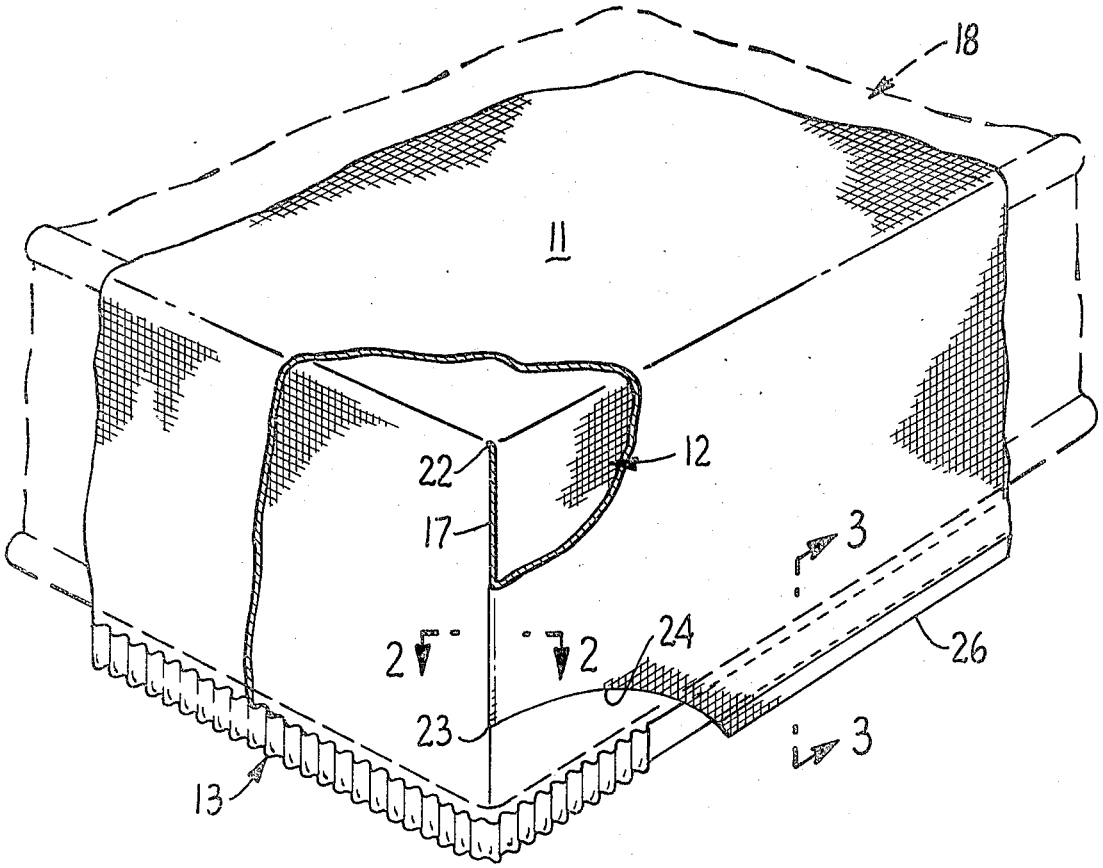
FIG. 1 is a fragmentary perspective view of a fitted corner construction made in accordance with the present invention and shown in operative relation to a mattress, portions of the structure being broken away and shown in section for clarity of illustration.

While only the preferred embodiments of the invention have been illustrated in the drawings, it will be apparent as the specification progresses that modifications could be made to the illustrated structure within the ambit of the claims.

DESCRIPTION OF THE PREFERRED EMBODIMENTS

Referring now to the drawings in detail, it will be seen that the fitted double sheet construction of the present invention utilizes an upper sheet 11 and a lower sheet 12 having a joinder 13 along the foot ends of the two sheets, the upper and lower sheets having notches 14 and 16, respectively, cut from the corners of the sheets at the foot end, the notches of the two sheets being sewn together, as at 17 to form doubled box corners for receiving the corners of the mattress 18 at its foot end.

Means is provided for securing the bottom sheet 12 in place on the mattress 18. This means may comprise any suitable retaining means, but preferably and as here shown, the bottom sheet 12 is releaseably securable in place on the mattress 18 by means of the doubled box corners at the foot end and by single box corners at the head end. As may be seen in FIG. 4 of the drawings, the single box end is provided by notches 19 formed in the corners of the bottom sheet at the head end and thereafter sewn together to provide the fitted box end.

As an important feature of the present invention, the upper sheet 11 is sewn only part way along the doubled box corners at the foot end so that the side portions of the upper sheet can hang free adjacent to the doubled box corners.

Figure 2:
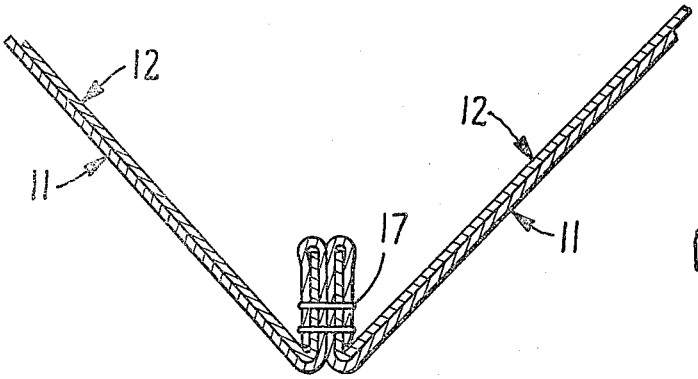
FIG. 2 is an enlarged cross-sectional view taken substantially on the plane of line 2—2 of FIG. 1.
Figure 3:
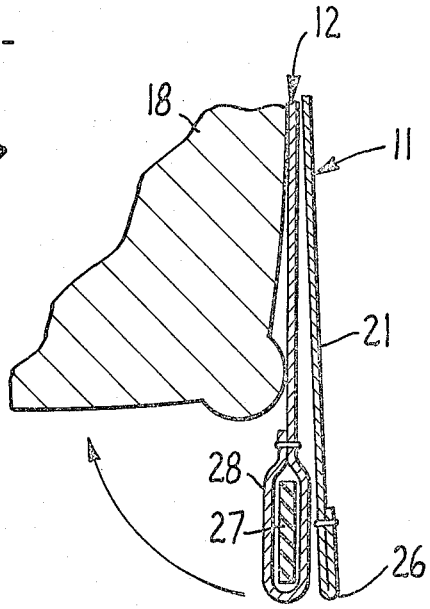
FIG. 3 is an enlarged cross-sectional view taken substantially on the plane of line 3—3 of FIG. 1.

This structure may best be seen in FIG. 1 of the drawings. As there shown, the side portion 21 of upper sheet 11 is sewn into the box corner only between points 22 and 23 so that the flap below point 23 can hang freely. If desired, and as here shown, a further cutout 24 may be provided between point 23 and the extreme edge 26 of the upper sheet. This assists in avoiding bunching at the corner. The preferred manner of sewing the seam between points 22 and 23 is illustrated in FIG. 2 of the drawings.

The doubling of the fabric of the two sheets sewn together at the corners of the lower ends thereof materially strengthens the box corners and, perhaps more importantly, tends to keep the upper and lower sheets in alignment, both when used on the bed and while being washed or dried. The structure has been found to aid in avoiding tangling during washing and drying.

Figure 4:
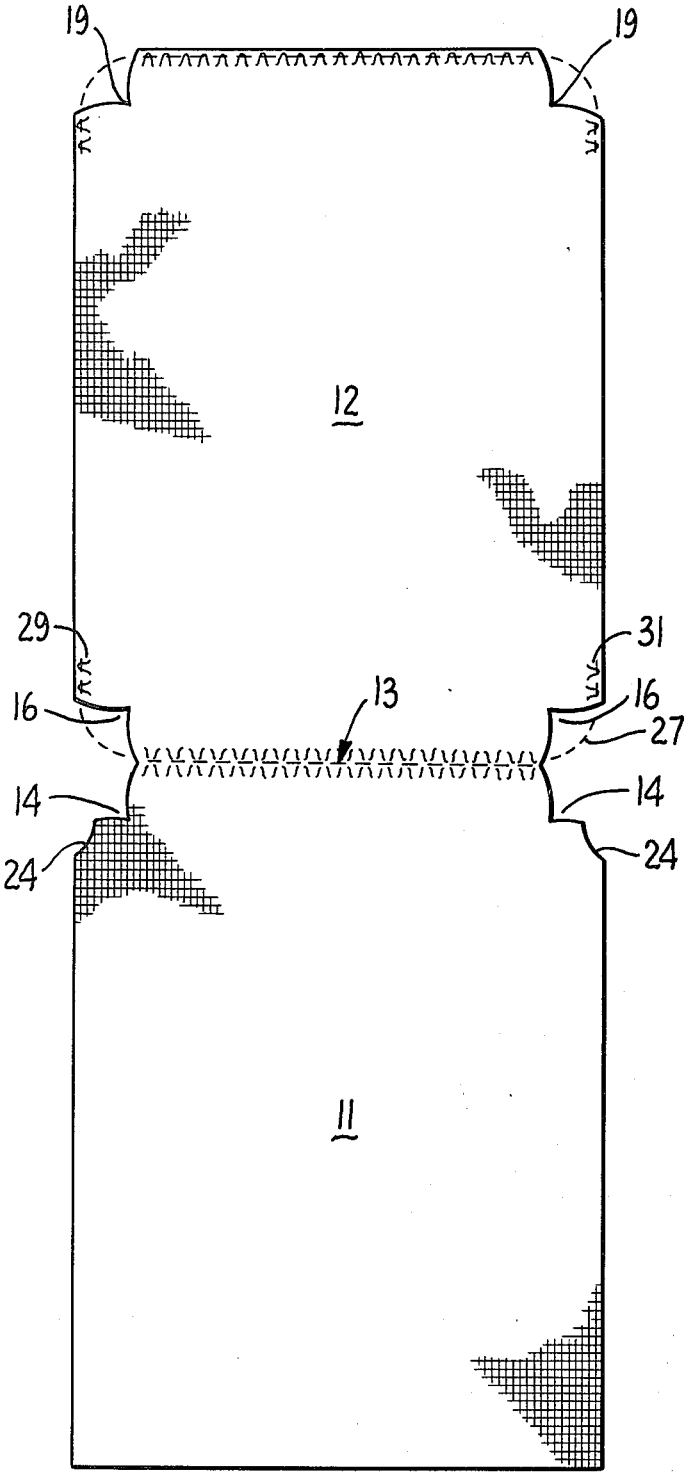
FIG. 4 is a plan view of a fabric blank constructed in accordance with the present invention.

In accordance with the present invention, and as may best be seen from FIG. 4 of the drawings, both the upper and lower sheets are generally rectangular in outline so as to make most efficient use of fabric. The only portions which need to be cut away are the notches 14, 16, 19 and 24. Otherwise, all of the fabric is used. This feature also makes it possible to make both the upper sheet 11 and lower sheet 12 out of a single rectangular piece of fabric, with the continuity of the fabric providing the joinder 13. Alternatively, of course, if desired the upper and lower sheets can be made from two separate rectangular pieces of fabric.

Figure 5:
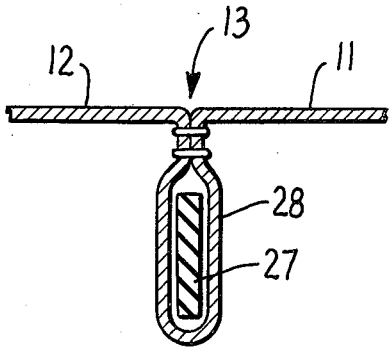
FIG. 5 is an enlarged typical cross-sectional view taken through an elastic strip and containing pocket therefore forming part of the present invention.
Figure 6:
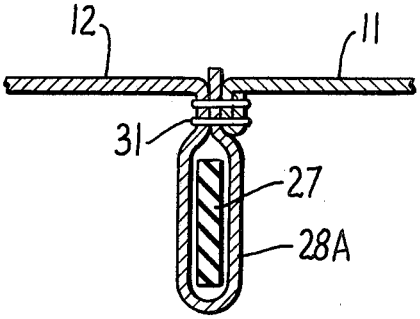
FIG. 6 is a view similar to that of FIG. 5, but illustrating an alternate form of construction.

Preferably, and as here shown, an elastic strip 27 is utilized to keep the foot end of the bottom sheet 12 snugly in place around the foot end of the mattress 18. As a feature of the invention, the elastic strip 27 is contained within an elongated fabric pocket 28, the strip 27 being of shorter length than the length of the pocket and secured at its ends 29 and 31 to the lower sheet.

Where a single panel of fabric is used for making both the upper and lower sheets, the pocket 28 is conveniently provided in the manner illustrated in FIG. 5 of the drawings, simply by taking a tuck in the fabric along the joinder 13. Where the upper and lower sheets are made of separate panels of fabric, the elastic strip 27 is contained within a pocket 28A preferably formed along the bottom edge of the lower sheet 12, with the upper sheet 11 being sewn thereto along the throat of the pocket as illustrated at 31 in FIG. 6.

In view of the foregoing, it will be seen that the fitted double sheet construction of the present invention offers significant improvements in utilization of fabric, strength, and maintenance of alignment of the upper and lower sheets.

What we claim is:

1. A fitted double sheet for beds, comprising: upper and lower sheets joined along the foot end thereof;

said upper and lower sheets having notches cut from the corners at said foot end and being sewn together and to each other to form doubled box corners for receiving the corners of the mattress at its foot end;

said upper sheet being sewn only part way along said doubled box corners, whereby the side edges of said upper sheet hang free along their entire lengths; and means for securing said bottom sheet in place on the mattress.

2. A fitted double sheet for beds, comprising:

upper and lower sheets joined along the foot end thereof;

an elongated pocket formed along the joinder between said upper sheet and said lower sheet; and an elastic strip of shorter length than said elongated pocked contained within said pocket and secured at its ends to said lower sheet;

said upper and lower sheets having notches cut from the corners at said foot end and being sewn together and to each other to form doubled box corners for receiving the corners of the mattress at its foot end;

said upper sheet being sewn only part way along said doubled box corners whereby the sides of said upper sheet hang free along their entire length.

* * * * *